US008561853B2

(12) United States Patent
De Mei

(10) Patent No.: US 8,561,853 B2
(45) Date of Patent: Oct. 22, 2013

(54) AIRTIGHT PRESERVATION SYSTEM

(76) Inventor: Mauro De Mei, Sermoneta (IT)

( * ) Notice: Subject to any disclaimer, the term of this patent is extended or adjusted under 35 U.S.C. 154(b) by 1055 days.

(21) Appl. No.: 12/525,210

(22) PCT Filed: Feb. 21, 2008

(86) PCT No.: PCT/IB2008/050628

§ 371 (c)(1),
(2), (4) Date: Jul. 30, 2009

(87) PCT Pub. No.: WO2008/104906

PCT Pub. Date: Sep. 4, 2008

(65) Prior Publication Data

US 2010/0101426 A1 Apr. 29, 2010

(30) Foreign Application Priority Data

Feb. 26, 2007 (WO) ..... PCT/IT2007/000134

(51) Int. Cl.
*B67D 7/60* (2010.01)

(52) U.S. Cl.
USPC ..... 222/386.5; 222/153.04; 222/153.09; 222/484; 222/400.7

(58) Field of Classification Search
USPC ..... 222/95, 153.09, 153.01, 153.1, 319, 222/386.5, 481, 484, 153.04, 400.7
See application file for complete search history.

(56) References Cited

U.S. PATENT DOCUMENTS

| | | | | |
|---|---|---|---|---|
| 878,389 | A * | 2/1908 | Henry | 222/319 |
| 1,696,391 | A * | 12/1928 | Eckberg | 222/400.7 |
| 2,023,837 | A * | 12/1935 | Heins | 222/195 |
| 2,286,797 | A * | 6/1942 | Duerme | 215/11.3 |
| 2,673,013 | A * | 3/1954 | Hester | 222/386.5 |
| 3,300,102 | A | 1/1967 | Budzich | |
| 4,239,132 | A * | 12/1980 | Mueller et al. | 222/212 |
| 4,366,921 | A * | 1/1983 | Kirk, Jr. | 222/153.09 |
| 4,392,578 | A | 7/1983 | Fipp et al. | |
| 4,809,884 | A * | 3/1989 | Stackhouse | 222/153.04 |
| 4,984,713 | A | 1/1991 | Chambers et al. | 222/105 |
| 5,499,758 | A * | 3/1996 | McCann et al. | 222/386.5 |
| 5,667,110 | A | 9/1997 | McCann et al. | 222/386.5 |
| 6,502,725 | B1 * | 1/2003 | Alexander | 222/185.1 |
| 7,395,949 | B2 * | 7/2008 | Ehret et al. | 222/386.5 |

FOREIGN PATENT DOCUMENTS

| | | |
|---|---|---|
| BE | 1010729 | 12/1998 |
| DE | 4125584 | 2/1992 |
| EP | 0312342 | 4/1989 |
| GB | 2202836 | 10/1998 |
| WO | 95/21109 | 8/1995 |
| WO | 97/46446 | 12/1997 |

OTHER PUBLICATIONS

International Search Report for PCT/IT2007/000134 filed on Feb. 26, 2007 in the name of Mauro De Mei.

(Continued)

*Primary Examiner* — Kevin P Shaver
*Assistant Examiner* — Patrick M Buechner
(74) *Attorney, Agent, or Firm* — Steinfl & Bruno LLP

(57) ABSTRACT

The present invention relates to an airtight preservation system of a consumer fluid within a container, and in particular a system for the preservation of said fluid, typically intended for alimentary consumption, from contamination by contact with outside atmosphere, in particular during the phase of delivery. The system according to the present invention is of easy installation, by virtue of a compact structure applicable to any container size and of an operation marked by utmost rationality.

52 Claims, 6 Drawing Sheets

(56) References Cited

OTHER PUBLICATIONS

Written Opinion for PCT/IT2007/000134 filed on Feb. 26, 2007 in the name of Mauro De Mei.

PCT International Search Report for PCT/IB2008/050628 filed on Feb. 21, 2008 in the name of Mauro De Mei.

PCT Written Opinion for PCT/IB2008/050628 filed on Feb. 21, 2008 in the name of Mauro De Mei.

* cited by examiner

AIRTIGHT PRESERVATION SYSTEM

CROSS REFERENCE TO RELATED APPLICATIONS

The present application is the US national stage of International Application PCT/IB2008/050628 filed on Feb. 21, 2008 which, in turn, claims priority to International Application PCT/IT2007/000134, filed on Feb. 26, 2007.

The present invention relates to an airtight preservation system of a consumer fluid within a container, and in particular a system for the preservation of said fluid, typically intended for alimentary consumption, from contamination by contact with outside atmosphere, in particular during the phase of delivery.

Hence, the present invention addresses the field of the manufacturing of devices for the airtight closure of vessels and/or controlled delivery of their content.

The present invention finds a particularly useful and advantageous use in the to storage and dispensing of fluids exhibiting effervescence and/or having volatile properties.

Extended preservation and safer protection of products subject to contamination, or anyhow to alteration of their physicochemical properties when not properly shielded from the outside environment, are certainly desirable in view of the convenience attainable in terms of saving, product yield and consumer's interests safeguarding.

Moreover, the ever-stricter hygiene and safety laws passed on the matter of preservation and storage of intrinsically perishable fluid food products, or generally of products with features such as to impose an adequate insulation thereof from the outside environment, make ever more pressingly felt the need to optimize the sealing power of the vessels appointed to the containment of such typologies of products or materials.

Traditionally, particularly for effervescent fluids, during their delivery and/or preservation by means of known sealing closures, a process defect occurs, manifesting itself as some form of contamination of the treated fluids or of loss of their features.

In fact, the current art offers a number of solutions of sealing systems to be applied in liquid preservation, yet they fail in the attempt of fully solving the problem. The action of gases dissolved in liquids, especially when the liquids are effervescent, causes anyhow a leakage of gases present in the atmosphere into the container, thereby to the detriment of the properties of the liquid contained therein.

In addition, most of the times the known art systems are extremely complex and do not entail the option of being removably positioned on the containers holding the liquid to be preserved.

Hence, object of the present invention is to solve said problems by proposing an airtight preservation system of a fluid as defined in claim 1.

The airtight preservation system according to the present invention optimizes the hermetic closure ability of containers.

Hence, the airtight preservation system according to the present invention is suitable for the metering of foods such as drinks, and in particular fizzy (carbonated) drinks; or wine or oil; and generally of fluids typically intended for containers such as tanks; cans; reservoirs; containers and the like; pharmaceutical solutions and drip bags.

Thanks to its versatility, the airtight preservation system according to the present invention can advantageously and cost-effectively be adapted to any container typology and shape.

The system according to the present invention, is of easy installation, by virtue of a compact structure applicable to any container size and of an operation marked by utmost rationality.

Other advantages, features and the operation modes of the present invention will be made evident by the following detailed description of two embodiments thereof, given by way of example and not for limitative purposes. Reference will be made to the figures of the annexed drawings, wherein.

Figure 8:
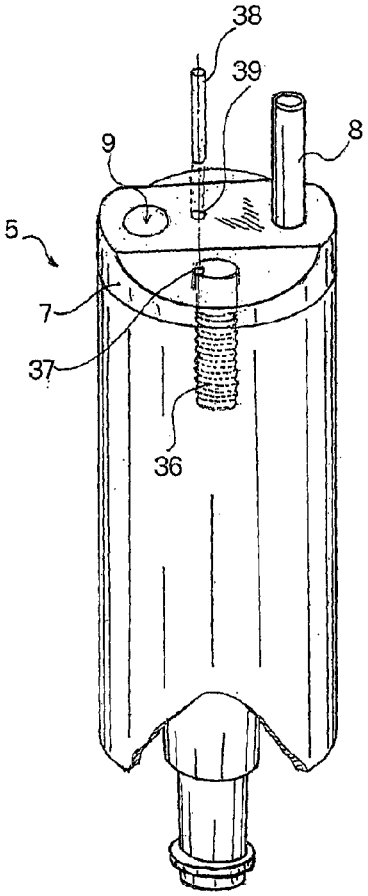
Figure 3:
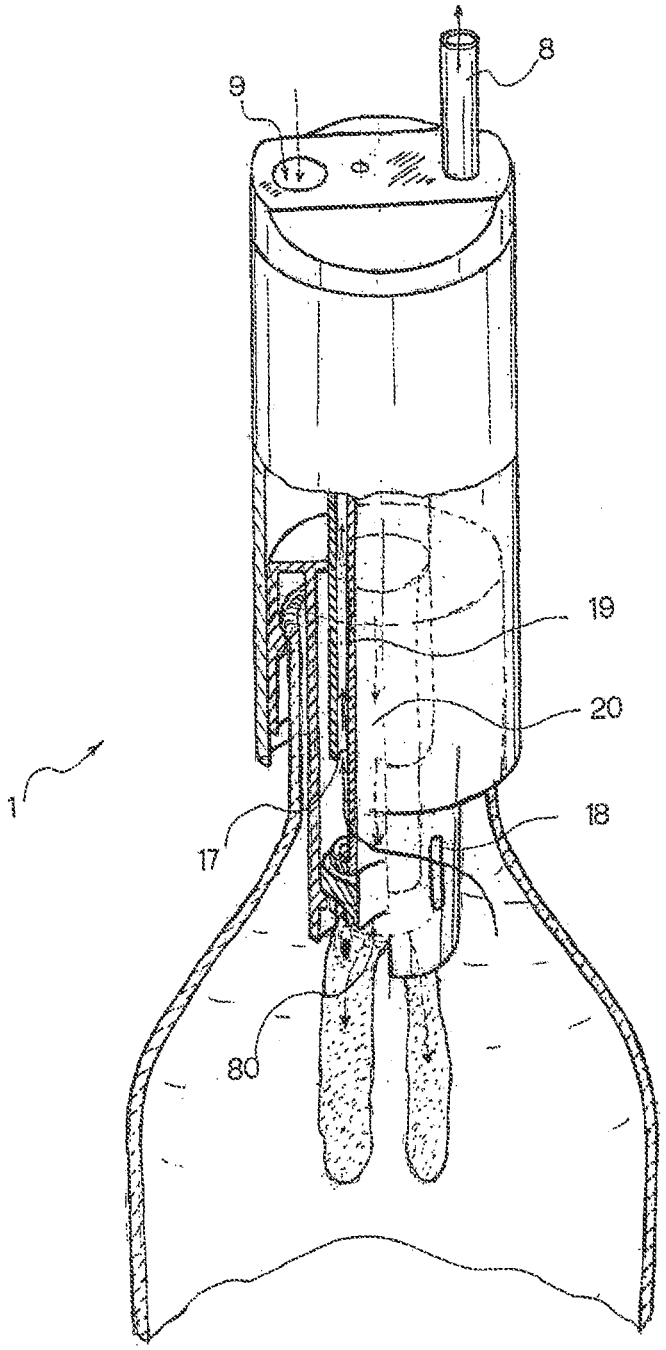
Figure 4A:
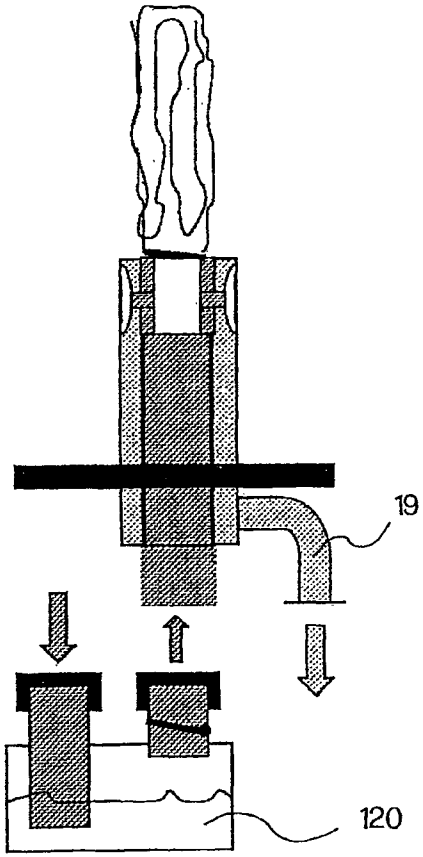
Figure 4:
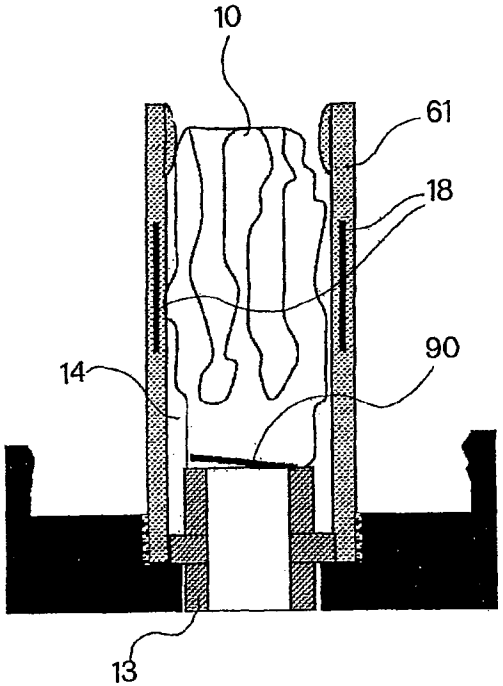
Figure 5:
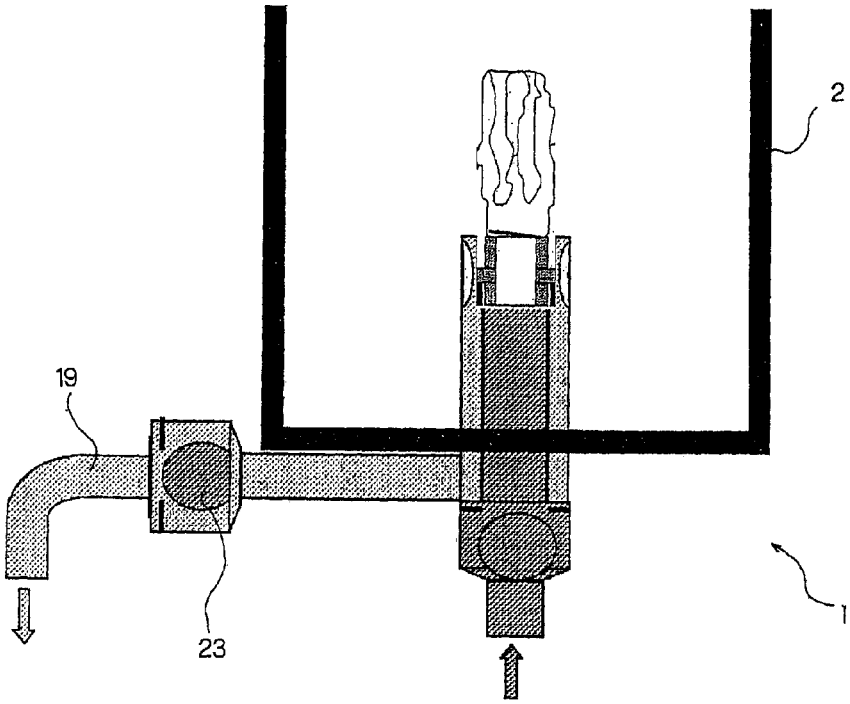
Figure 6:
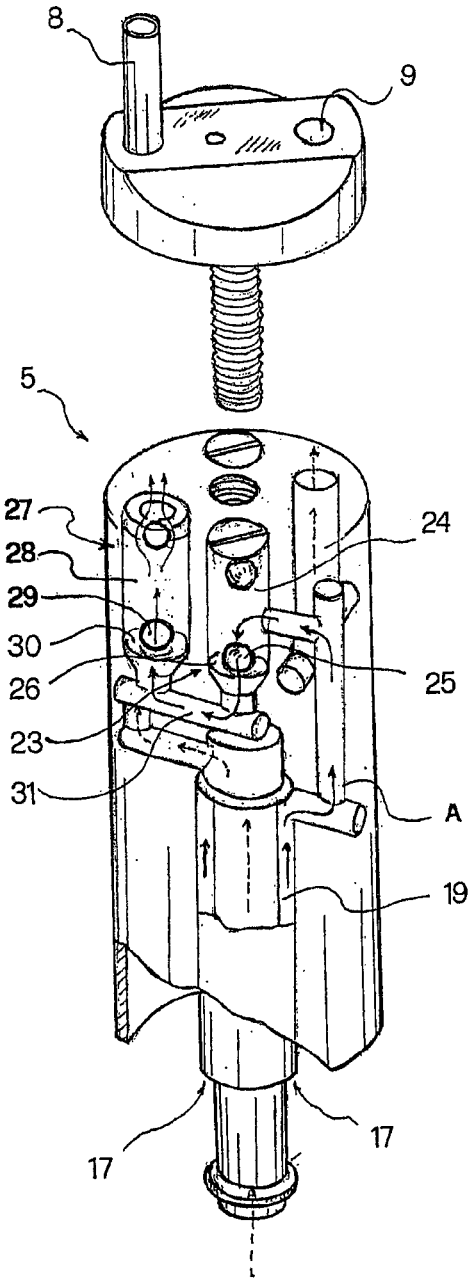
Figure 7:
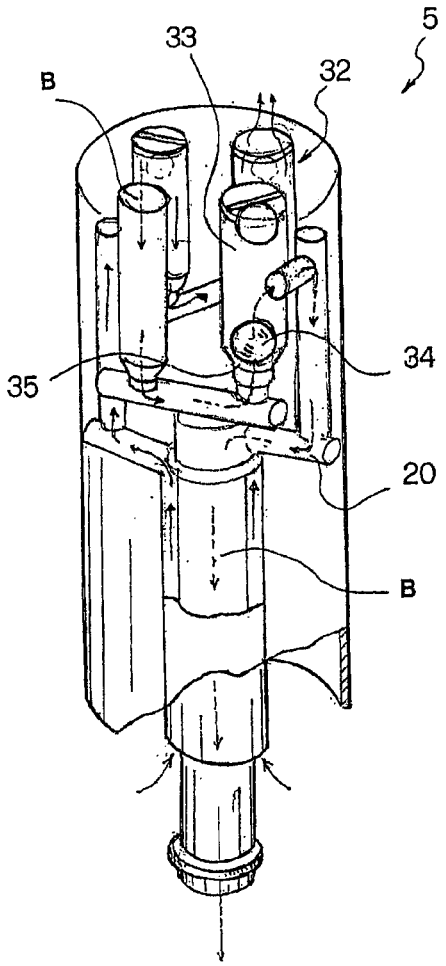

FIG. 3 sectionally shows a perspective view of the airtight preservation system subject-matter of the present invention; and FIGS. 4, 4A and 5 show, in a schematic view, details of the system subject-matter of the present invention;

FIGS. 6 and 7 show, in a perspective view, a detail of the system subject-matter of the present invention; and FIG. 8 shows, in a perspective view, a detail of the system subject-matter of the present invention.

Figure 1:
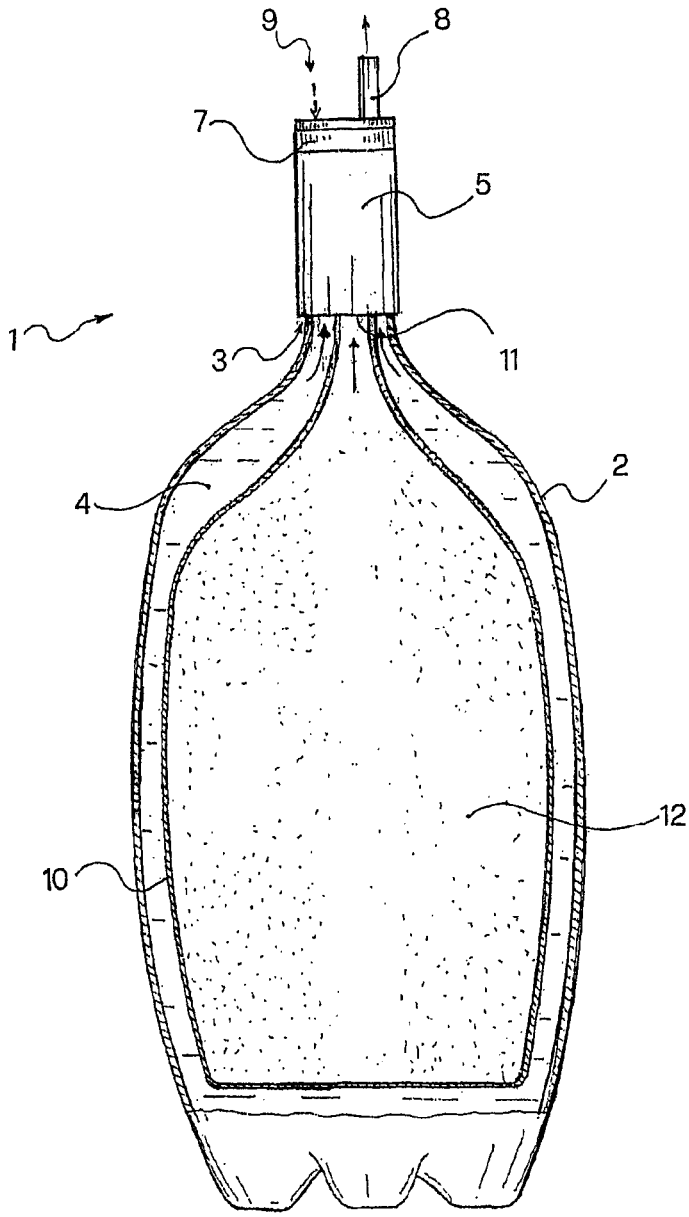
FIG. 1 shows in a front view an airtight preservation system according to the present invention.

In particular, specifically referring to FIG. 1, it is shown an airtight preservation system 1 applied to a container 2 having an inlet 3. Inside the container 2 a consumer fluid is present, denoted in figure by reference numeral 4.

The system 1 subject-matter of the present invention comprises, as it will be detailed hereinafter in the present detailed description, a device 5, preferably of substantially cylindrical shape, internally connected with a case (not shown in figure). The case is made integral to the container 2 by a removable fitting substantially at an inlet 3 thereof. The system 1 subject-matter of the present invention further comprises a plug 7, connected with the device 5 and having a delivery spout 8 and a through hole 9. The system 1 subject-matter of the present invention finally comprises a compensation casing 10, having an inlet mouth 11, connected to the system 1 by a connecting manifold internal to the case (it also not shown in FIG. 1). Inside the compensation casing 10 a substitute fluid 12 is present. Said substitute fluid 12 is preferably gaseous, in particular air, coming from an outside environment into the container 2. The delivery spout 8 and the through hole 9 put into communication, in the manner that will be detailed hereinafter, the outside environment respectively with an internal volume of the container 2 and the compensation casing 10.

The system 1 is such as to arrange, at a variation of the internal volume of the container 2 taken up by the consumer fluid 4 concomitantly to a delivery of said fluid, a proportional flow of substitute fluid 12 into the compensation casing 10 in order to compensate for said internal volume variation, and keep the overall pressure internally to the container 2 at a substantially constant predetermined value.

Hence, it is evident how the compensation casing, preferably made of gas-proof material, be such as to define a chamber internal to said container 2 defining just a volumetric partition of the container 2 between the consumer fluid 4 and the substitute fluid 12, according to proportions such as to keep substantially constant the pressure internally to the container 2. Therefore, thus it is possible to deliver the consumer fluid 4 without detriment to the fluid remaining inside the container after the delivery, preventing any contact between it and the substitute fluid 12 present in the outside environment.

Figure 2B:
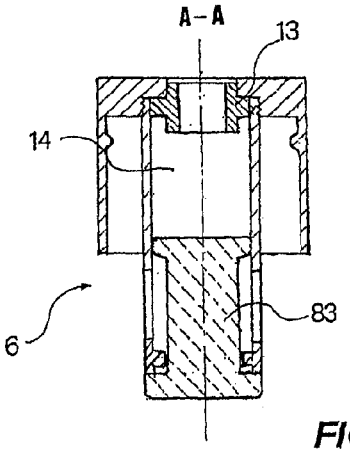
FIG. 2B shows a section of a detail of the system subject-matter of the present invention along a line A-A highlighted in FIG. 2.
Figure 2:
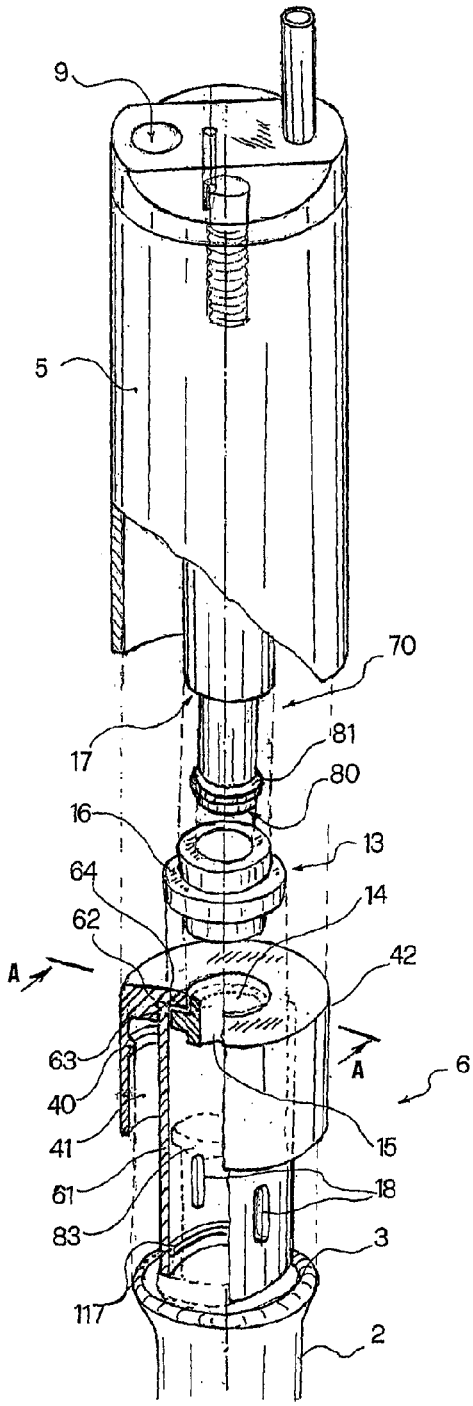
FIG. 2 shows in an exploded perspective view the system according to the present invention.

Referring to FIG. 2, there are shown in more details the component parts of the airtight preservation system 1 subject-matter of the present invention. In particular, the device 5 is removably connected with the connecting manifold, now shown in figure and denoted by reference numeral 13. The case, having it also a substantially cylindrical shape and shown in figure denoted by reference numeral 6, is, as mentioned, removably inserted into the container 2 at the inlet 3. Moreover, always referring to FIG. 2, the case 6 comprises a body 61 defining a through seat 14 apt to define a passage between the outside environment and the inside of the container 2.

The system subject-matter of the present invention is made in a manner such as to have the special property of being applicable on any one container and being removed therefrom when, e.g., the consumer liquid is all gone.

For this purpose, the case 6 has grip means, preferably of pressure type, apt to make said removable fitting at the inlet 3. The grip means comprises, by way of a non-limiting example, a cap 42 coupled to said body 61, arranged externally to the through seat 14 and defining a compartment 41 external thereto. The cap 42 has a fastening ledge 40, apt to cooperate with the inlet 3 in order to make such a removable pressure fitting. Additionally, or alternatively, between the cap 42 and the inlet 3, a gasket (not shown in figure) could be arranged to increase the sealing of the case 6 on the container 2. Otherwise, when an irreversible fitting of the case 6 into the container 2 is to be made, the cap 42, upon fitting the inlet 3 within the compartment 41, may advantageously be tightened by thermal jaw, thereby obtaining a plastic deformation of the cap about the inlet of the container, subsequently preventing an extraction of the case from the container itself.

The cap 42 is removably coupled to the body 61. In particular, the body 61 has a threaded portion 62 placed substantially at a top end thereof, apt to engage a complementary threaded portion 63 obtained within the cap 42. Moreover, the cap 42 has, substantially at said complementary threaded portion 63, an opposing ledge 64. The body 61 in turn has an internal end projection 117.

Moreover, the connecting manifold 13, it also of a substantially cylindrical shape, is connected, at a bottom end 15 thereof, to the compensation casing, not shown, and externally has a preferably peripheral ledge 16. The manifold 13 is such as to slide internally to said through seat 14 to a sealing stop position, in which the ledge 16 cooperates with the projection 117 and does not allow a further sliding of the manifold 13 inside the seat 14. Therefore, it is evident that the compensation casing is fitted inside the container 2 via the through seat 14.

The connecting manifold 13, in turn, owing to the projection 117 and the opposing ledge 64, should necessarily be inserted inside the body 61 (together with the compensation casing) prior of it being screwed to the cap 42.

The device 5 has a portion 70 apt to be inserted internally to the body 61 at the through seat 14. From said internal portion 70 there stems, at a first mouth 80, a first internal duct apt to put into communication the outside environment (via the through hole 9) with the compensation casing through the connecting manifold 13, and a second internal duct communicating with the inside of the container 2 by a preferably peripheral second mouth 17, obtained just on the end portion 70 of the device. Said case 6 in turn has, on a side wall thereof, slots 18, only two thereof being shown in figure, by way of example. Each slot is positioned in a manner such that, when the device 5 is connected with the connecting manifold in the stop position, the mouth 17 receives, in the phase of delivery, the consumer fluid 4 which reaches the second duct by flowing through the slots 18.

The device portion 70 comprises, substantially at the first mouth 80, a peripheral ledge 81, apt to cooperate with the ledge obtained on the connecting manifold in a manner such as to establish a sealing connection therewith.

Finally, always referring to FIG. 2, the system 1 subject-matter of the present invention comprises an airtight closure seal 83, fitted into the through seat 14 and depicted in the figure by a hatching. The seal 82 is positioned so that the fitting of the portion 70 into the through seat 14 be such as to free the passage defined by said seat, pushing said airtight closure seal 82 into the compensation casing 10.

Referring to next FIG. 2B, it is highlighted a section of the case 6 along line A A. In particular, the connecting manifold 13 is clearly visible. It, once said portion (not shown in figure) of the device is fitted into the seat, causes its sliding along the seat 14 thereby determining the ejection of the airtight closure seal 83 therefrom. The closure seal, as mentioned, is pushed inside the compensation casing for the entire service life of the system subject-matter of the present invention.

Referring now to next FIG. 3, it is depicted a sectional perspective view of the system 1 subject-matter of the present invention. In particular, there can be clearly seen the second duct of the device 1, now denoted in figure by reference numeral 19. The consumer fluid 4 present inside the container flows from the container 2 within the second duct 19 through the second mouth 17, during a phase of delivery, by means of the openings 18. Thus, the consumer fluid 4 reaches the spout 8 and then is delivered. Concomitantly, the substitute fluid 12 is intaken from the outside environment into the first duct, denoted in figure by reference numeral 20, via the through hole 9, and reaches the compensation casing 10 by passing through the first mouth 80. Therefore, it will easily be understood how the compensation casing 10 be initially all compressed when the container 2 is full, and gradually expands as the consumer liquid 4 is delivered, thereby compensating the internal volume variation in the container 2 caused just by the delivery of the liquid 4.

Referring now to FIG. 4, it is depicted the section of the case 6 in which the connecting manifold 13 is not yet in a sealing stop position against the projection 117. In order not to overburden the figure, the airtight closure seal is not depicted. However, there can be seen the compensation casing 10, compressed and still all contained inside the through seat 14 of the body 61.

The system subject-matter of the present invention comprises irreversible induction means, arranged along the first duct, such as to arrange, at a variation of the internal volume taken up by the consumer fluid concomitantly to a delivery of said fluid, a proportional flow of substitute fluid into the compensation casing 10, in order to compensate the internal volume variation and keep the overall pressure internally to the container at a substantially constant predetermined value.

Therefore, it is evident how the compensation casing 10, preferably made of gas-proof material, be such as to define a chamber internal to said container 2, defining just a volumetric partition of the container 2 between the consumer fluid 4 and the substitute fluid 12, according to proportions such as to keep substantially constant the pressure internally to the container 2. Hence, thus it is possible to deliver the consumer fluid 4 without detriment to the fluid that, after the delivery, remains inside the container preventing any contact between it and the substitute fluid 12 present in the outside environment.

Always referring to FIG. 4, the irreversible induction means comprises a check valve 90, apt to allow an irreversible induction of said substitute fluid inside said compensation casing 10.

FIG. 4A schematically illustrates a possible use of the system 1 according to the present invention, for a pharmaceutical purpose, e.g. intravenous drip phials or the like. In fact, thanks to the system subject-matter of the present invention it is possible to administer a fluid by intravenous drip, exploiting the substitute fluid that is intaken inside the compensation casing as indicator for administration. Thus, it is preserved the liquid to be administered, which by flowing into the duct 19 prevents any contact with the outside environment. The substitute fluid, intaken in the first duct thanks to a pressure gradient setting in by means of said irreversible induction means, is passed through a hydraulic head 120, generating small bubbles during its transit. Therefore, said bubbles assume the role of indicator that the administration of liquid inside the patient's body is actually occurring.

Referring now to FIG. 5, it is shown the system 1 subject-matter of the present invention in which the second duct 19 preferably comprises valve means comprising an antireflux one-way check valve 23. Said valve means is positioned along the second duct 19 to reinforce the airtight closure thereof and hinder any undesired and accidental replenishment of substitute fluid, usually air, from the outside atmosphere to the container 2, synergistically with the effect of said balancing of pressure and volumes.

The system subject-matter of the present invention, comprising said antireflux one-way valve 23 along the second duct 19, finds application for the traditional "bottles" or anyhow beverage containers for in-cup dispensing.

In case the consumer fluid to be delivered has specific volatile properties, e.g. for fizzy (carbonated) drinks, always falling within the same inventive concept, said valve means are such as not to allow gases dissolved into the consumer fluid to cause the re-entering of substitute fluid inside the container itself. Next FIGS. 6 and 7 illustrate in detail the abovedescribed situation.

In said figures there are illustrated in detail said first and second duct. Referring to FIG. 6, the second duct 19 is shown. In particular, by an arrow A it is shown a path followed by the consumer fluid flowing through the second mouth 17 during the phase of delivery. The device 5 comprises along said second duct 19 the valve means, which in turn comprises the antireflux one-way valve 23, analogously to the preceding instance and now viewable in a perspective view. Said antireflux one-way valve 23 comprises a first compartment 24 in which it is present a first sealing body 25, slidably movable between a sealing position when the container is in a resting position, and an opening position when the container is in a delivering condition. In particular, the first sealing body, preferably spherical, is apt to engage, when in sealing position, a first airtight closure seat 26 placed at a base of the compartment, and is apt to detach from said first seat 26 when in an opening position. As it is evident from FIG. 6 at issue, the second duct 19 is such as to intercept said first compartment in a raised position with respect to the first airtight closure seat 26, when the container is in a resting position.

Moreover, the valve means comprise a second antireflux one-way valve 27, interposed between the first valve 23 and the outside environment. The second antireflux one-way valve 27 is in all analogous to the first valve 23, therefore it also comprising a second compartment 28, and a second sealing body 29, preferably spherical, engaging a second airtight closure seat 30 when the container is in a resting condition, and detaches therefrom when the container is in the phase of delivery.

In particular, said first and second compartments 24, 28 are substantially parallel therebetween, and communicating therebetween by a portion 31 of the second duct 19 intercepting them at their respective airtight closure seats.

During the phase of delivery, the spherical bodies 25 and 29 of the two antireflux one-way valves 23 and 26 detach from the respective airtight closure seats, e.g. under the action of gravity triggered by an upturning of the container, and allow the transit of the consumer liquid through the duct 19 until reaching the delivery spout 8. When the container is in a resting condition, the arrangement of the valve means along the second path 19 is such as not to allow a re-entering of the substitute fluid inside the consumer fluid contained in the container, jointly with not allowing an outletting of the fluid to the outside environment. In fact, consider the case in which gases dissolved into the consumer fluid exit the fluid itself and flow into the second duct, increasing its pressure. The illustrated situation is particularly frequent in case the consumer fluid is, as mentioned above, a fizzy drink. Then, the above-mentioned gases reaches the first antireflux valve 23 and flow into the compartment 24. Yet, the pressure increase occurring in said compartment no more than pushes the spherical body 25 within the respective airtight closure seat 26. This remarkable advantage is attained thanks to the relative arrangement between the antireflux valve 23 and the second duct 19. The second antireflux valve 27 acts in a wholly analogous manner. In case an external pressure increase occurs (with respect to the pressure acting in the second duct 19), the airtight closure seat is further sealed by the respective spherical body 29. In case an external negative pressure occurs, the spherical body 29 detaches from its closure seat allowing a transit of substitute fluid within the portion of second duct 31, yet the negative pressure concomitantly causes the sealing of the first airtight closure seat 26 by the spherical body 25. Therefore, it is evident how the present invention, by the arrangement of said valve means along the second duct, advantageously solves the technical problem of avoiding consumer fluid outletting or consumer fluid re-entering in any one applicative scenario.

Referring to next FIG. 7, showing the device 5 rotated of an angle of about 180° with respect to the view of FIG. 6, the first duct 20 is shown. In particular, by an arrow B it is shown a path of the substitute fluid intaken within the compensation casing (not shown in figure) during the phase of delivery. The device 5 comprises, along said first duct 20, the means for the irreversible induction of the substitute fluid. Such means for the irreversible induction of the substitute fluid comprises, in this case, a third antireflux one-way valve 32 in all analogous to those arranged along the second duct. Said valve therefore comprises a third compartment 33, in which it is present a third sealing body 34, preferably spherical, engaging a respective third airtight closure seat 35. When the container is in the phase of delivery, the third sealing body 34 detaches from the respective airtight closure seat, allowing the substitute fluid to flow into the first duct 20 and reaches the compensation casing (not shown in figure). It has to be pointed out how, in this case, it is superfluous to introduce a fourth antireflux one-way valve, as any overpressure of the outside environment would cause a re-entering of substitute fluid that anyhow would flow within the compensation casing, with no risk of interference with the consumer fluid present inside the container. Moreover, it is important to stress that said airtight closure seats 26, 30 and 35 are characterized by having a substantially flared shape, having a flare angle such that the sealing bodies detach from their respective seat also for slight tilting of the container during the delivery. In particular, said flare angle is preferably greater than or equal to 90°.

Referring to the last FIG. 8, the device 5 is sealingly connected with the removable plug 7, onto which there are obtained said delivery spout 8 and the through hole 9 located in correspondence of, respectively, said second and first duct. The plug 7 comprises a threaded pin 36 apt to engage a complementary threaded portion obtained into the device 5. In particular, the plug 7 is pivotably connected with said pin 36. In order to engage the complementary portion obtained in the device 5, the plug comprises operable locking means, apt to make integral the plug to the threaded pin, thereby making possible the engagement of the latter into the device 5. The operable locking means comprises a notch 37 obtained on the threaded pin. The notch is apt to be engaged by an opposing element 38, passed through the plug via a through hole 39. When inserted into the notch, the opposing element makes integral the plug 7 to the threaded pin, and therefore makes it possible, by acting on the plug itself, the engagement of the pin within the device 5. Once the plug is sealingly connected within the device, the extraction of the opposing element from the notch allows to close the plug 7, by means of a rotation thereof that brings the delivery spout not any more in correspondence of the second duct, however always remaining sealed.

In this case as well, the connecting manifold has, preferably, the check valve 90 (previously illustrated in FIG. 4), apt to allow an irreversible induction of substitute fluid inside the compensation casing. Thus, the system subject-matter of the present invention allows the extraction of the device from the case, in order e.g. to carry out standard maintenance operations, without detriment to the properties of the fluid.

The case could advantageously be made of highly cost-effective materials, and therefore be of disposable type and thrown away along with the container when it has run out of consumer fluid to be delivered. Thus, it is conceivable to size the system subject-matter of the present invention in a manner such as to insert the case into the container making a sealed fitting, with no need to worry to have to extract the case later on for a subsequent use.

Finally, the substitute fluid could, alternatively, be intaken inside the compensation casing with pressure, by the use of pumping means, during the phase of delivery of the consumer fluid.

The present invention has hereto been described with reference to two preferred embodiments thereof. It is understood that other embodiments afferent to the same inventive concept might exist, all falling within the protective scope of the claims hereinafter.

The invention claimed is:

1. A system for airtight preservation of a consumer fluid present within a container having an inlet, said system comprising:

a case adapted to be made integral with said container by a fitting in correspondence of said inlet, said case comprising a body having a through seat adapted to define at least one passage between an outside environment and the inside of the container;

a compensation casing having an inlet mouth, said casing being adapted to be inserted within said container via said through seat and adapted to receive a substitute fluid;

a connecting manifold connected to said compensation casing in correspondence of said inlet mouth, said manifold being such as to slide into said through seat to a sealing stop position;

a device adapted to be removably connected with said manifold, said device comprising a portion adapted to be contained within said through seat, said device comprising a first duct adapted to put into communication said compensation casing with environment external to the container through said connecting manifold, and comprising a second duct adapted to put into communication an inside of the container with said environment through said at least one passage, said device further comprising means for irreversible induction of the substitute fluid along said first duct;

wherein said irreversible induction means arrange, at a variation of an internal volume taken up by said consumer fluid concomitantly to a delivery of said fluid, a proportional flow of said substitute fluid in said compensation casing in order to compensate for said internal volume variation and keep overall pressure internally to said container at a substantially constant predetermined value, and wherein said irreversible induction means also comprises an antireflux one-way valve.

2. The system according to claim 1, further comprising valve means along said second duct; said valve means being such as not to allow a re-entering of said substitute fluid within said second duct and not to allow an outletting of the fluid and/or of gas dissolved therein from the container when the container is in a resting position.

3. The system according to claim 2, wherein said valve means comprises an antireflux one-way valve.

4. The system according to claim 3, wherein said antireflux one-way valve comprises a first compartment housing a first sealing body, the first sealing body being slidably movable between a sealing position when the container is in a resting position, and an opening position when the container is in a delivering condition.

5. The system according to claim 4, wherein said first sealing body is adapted to engage, when in the sealing position, a first airtight closure seat placed at a base of said first compartment, and detach from said first seat when in the opening position.

6. The system according to claim 5, wherein said second duct intercepts said first compartment in a raised position with respect to said first airtight closure seat, when the container is in the resting position.

7. The system according to claim 3, wherein said first sealing body is spherical.

8. The system according to claim 4, wherein said valve means comprises a second antireflux one-way valve.

9. The system according to claim 8, wherein said second antireflux one-way valve comprises a second compartment in which a second sealing body is also slidably movable between a sealing position when the container is in the resting position, and an opening position when the container is in the delivering condition.

10. The system according to claim 9, wherein said second sealing body is adapted to engage, when in the sealing position, a second airtight closure seat placed at a base of said second compartment, and to detach from said second seat when in the opening position.

11. The system according to claim 10, wherein said first and second compartment are substantially parallel there between.

12. The system according to claim 10, wherein said first and second compartments are communicating through a portion of said second duct, said portion being connected to said first and second compartment respectively at said first and second airtight closure seat.

13. The system according to claim 8, wherein said second antireflux one-way valve is interposed, along said second duct, between said antireflux one-way valve and said outside environment.

14. The system according to claim 1, wherein said antireflux one-way valve comprises a compartment housing a sealing body, the sealing body being slidably movable between a sealing position when the container is in the resting position, and an opening position when the container is in the delivering condition.

15. The system according to claim 14, wherein said sealing body is adapted to engage, when in the sealing position, a airtight closure seat placed at a base of said compartment, and to detach from said seat when in the opening position.

16. The system according to claim 15, wherein said first duct intercepts said compartment in a raised position with respect to said airtight closure seat, when the container is in the resting condition.

17. The system according to claim 14, wherein said sealing body is spherical.

18. The system according to claim 1, wherein said connecting manifold comprises an external ledge.

19. The system according to claim 18, wherein said ledge extends along an entire peripheral development of said connecting manifold.

20. The system according to claim 1, wherein said through seat comprises an internal end projection.

21. The system according to claim 20, wherein said ledge is adapted to cooperate with said end projection to keep said connecting manifold in said sealing stop position.

22. The system according to claim 1, wherein said case comprises at least one slot on a side wall thereof.

23. The system according to claim 22, wherein said second duct communicates with said volume internal to the container at a second mouth located on said device at said portion internal to said through seat such that, when the device is connected with said connecting manifold in a stop position, said second mouth is adapted to receive, in a delivery phase, said consumer fluid flowing through said at least one slot.

24. The system according to claim 23, wherein said mouth is located at a periphery of said internal portion.

25. The system according to claim 1, wherein said device is sealingly connected with a removable plug comprising a delivery spout located in correspondence of said second duct, and a through hole located in correspondence of said first duct.

26. The system according to claim 25, wherein said plug comprises a threaded pin adapted to engage a complementary threaded portion obtained within said device.

27. The system according to claim 26, wherein said plug is pivotably connected to said threaded pin.

28. The system according to claim 27, wherein said plug comprises operable locking means, adapted to integrally connect, when operated, said plug with said threaded pin.

29. The system according to claim 28, wherein said operable locking means comprises a notch located on said threaded pin, said notch being adapted to be engaged by an opposing element, said opposing element being adapted to be inserted into said notch via a through hole located on said plug in correspondence of said notch.

30. The system according to claim 1, wherein said connecting manifold comprises a check valve, said valve being adapted to allow an irreversible induction of said substitute fluid inside said compensation casing.

31. The system according to claim 1, wherein said consumer fluid is a liquid.

32. The system according to claim 1, wherein said substitute fluid is of gaseous type.

33. The system according to claim 1, wherein said substitute fluid is air.

34. The system according to claim 1, wherein said compensation casing is substantially made of a gas-proof material.

35. The system according to claim 1, wherein said compensation casing defines a chamber internal to said container, defining a volumetric partition of said container between said consumer fluid and said substitute fluid according to proportions that keep a constant pressure internally to said container.

36. The system according to claim 1, wherein said compensation casing is substantially an expandable bag.

37. The system according to claim 1, wherein said device has a substantially cylindrical shape.

38. The system according to claim 1, wherein said case has a substantially cylindrical shape.

39. The system according to claim 1, wherein said connecting manifold has a substantially cylindrical shape.

40. The system according to claim 1, wherein said case comprises grip means adapted to provide said fitting into said inlet.

41. The system according to claim 40, wherein said grip means is a pressure grip means.

42. The system according to claim 40, wherein said grip means comprises a cap coupled to said body, arranged externally to said through seat and defining a compartment external thereto.

43. The system according to claim 42, wherein said cap comprises, internally to said compartment, a peripheral ledge, said peripheral ledge being adapted to cooperate with said inlet to provide said removable fitting.

44. The system according to claim 42, wherein said body is removably coupled to said cap.

45. The system according to claim 44, wherein said body comprises a threaded portion placed at a top end thereof, adapted to engage a complementary threaded portion obtained into said cap.

46. The system according to claim 45, wherein said connecting manifold comprises an external ledge and wherein said cap has an opposing ledge substantially at said complementary threaded portion, said opposing ledge being adapted to cooperate with said ledge of said connecting manifold such as not to allow said manifold to outlet from said through seat following extraction of the device from the case.

47. The system according to claim 1, wherein said portion of said device comprises a peripheral ledge adapted to cooperate with said connecting manifold such as to make a sealing connection therewith.

48. The system according to claim 1, wherein said case comprises an airtight closure seal fitted into said through seat, so that the fitting of said portion of the device into said through seat frees said at least one passage defined by said through seat and pushes said airtight closure seal into said compensation casing.

49. The system according to claim 48, wherein said airtight closure seal is inserted into said through seat by way of a pressure fitting.

50. The system according to claim 1, wherein said fitting of said case into said container is a removable fitting.

51. The system according to claim 1, wherein said fitting of said case into said container is an irreversible fitting.

52. The system according to claim 51, wherein said irreversible fitting occurs by plastic deformation of said case, through thermal jaws.

* * * * *

UNITED STATES PATENT AND TRADEMARK OFFICE

CERTIFICATE OF CORRECTION

PATENT NO. : 8,561,853 B2
APPLICATION NO. : 12/525210
DATED : October 22, 2013
INVENTOR(S) : Mauro De Mei It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1056 days.

Signed and Sealed this
Fifteenth Day of September, 2015

Michelle K. Lee

Michelle K. Lee
*Director of the United States Patent and Trademark Office*